US006749194B2

(12) United States Patent
Hanson et al.

(10) Patent No.: US 6,749,194 B2
(45) Date of Patent: Jun. 15, 2004

(54) DROP POCKET STACK HEIGHT AND OBJECT COUNT MONITORING SYSTEM AND METHOD

(75) Inventors: Bruce H. Hanson, Endicott, NY (US); Michael D. Senger, Vestal, NY (US); Bruce A. Williams, Conklin, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 238 days.

(21) Appl. No.: 10/004,594

(22) Filed: Dec. 5, 2001

(65) Prior Publication Data

US 2003/0105549 A1 Jun. 5, 2003

(51) Int. Cl.[7] ..... B65H 43/06; B65H 31/30

(52) U.S. Cl. ..... 271/176; 271/213; 414/790.5; 414/901

(58) Field of Search ..... 271/176, 207, 271/213, 218; 414/901, 926, 790.5

(56) References Cited

U.S. PATENT DOCUMENTS

| | | | | | |
|---|---|---|---|---|---|
| 3,593,860 | A | | 7/1971 | Brenner | 214/6 |
| 3,674,143 | A | | 7/1972 | Hunter et al. | 209/74 |
| 3,752,043 | A | * | 8/1973 | Rapparlie et al. | 414/790.4 |
| 3,782,541 | A | | 1/1974 | Wood | 209/74 R |
| 4,549,272 | A | | 10/1985 | Hagan et al. | 364/478 |
| 4,815,582 | A | | 3/1989 | Canziani | 198/365 |
| 5,101,981 | A | | 4/1992 | Carbone et al. | 209/548 |
| 5,138,817 | A | | 8/1992 | Mowry et al. | 53/399 |
| 5,222,857 | A | * | 6/1993 | Hasegawa | 414/788.4 |
| 5,338,149 | A | * | 8/1994 | Wiseman | 414/792.7 |
| 5,347,790 | A | | 9/1994 | Romanenko et al. | 53/443 |
| 5,421,464 | A | * | 6/1995 | Gillmann et al. | 209/584 |
| 5,464,201 | A | * | 11/1995 | Deen et al. | 270/53 |
| 5,503,388 | A | | 4/1996 | Guenther et al. | 271/300 |
| 5,538,140 | A | | 7/1996 | Guenther et al. | 209/552 |
| 5,556,252 | A | * | 9/1996 | Kuster | 414/796.7 |
| 5,772,391 | A | * | 6/1998 | Sjogren et al. | 414/790.9 |
| 5,887,698 | A | | 3/1999 | Soldavini | 198/360 |
| 5,961,115 | A | * | 10/1999 | Blanck et al. | 271/263 |
| 6,107,589 | A | | 8/2000 | Yamashita et al. | 209/584 |
| 6,126,017 | A | | 10/2000 | Hours | 209/698 |
| 6,135,292 | A | * | 10/2000 | Pettner | 209/603 |
| 6,166,346 | A | * | 12/2000 | Yamashita et al. | 209/584 |
| 6,190,116 | B1 | * | 2/2001 | Asada | 414/790.7 |
| 6,283,304 | B1 | * | 9/2001 | Gottlieb et al. | 209/603 |
| 2002/0140162 | A1 | * | 10/2002 | Gasser et al. | 271/213 |

FOREIGN PATENT DOCUMENTS

| | | | | |
|---|---|---|---|---|
| EP | 280410 | * | 5/1988 | H02K/15/02 |
| GB | 2111933 A | | 7/1983 | |
| JP | 57-72311 | * | 5/1982 | 29/738 |
| JP | 9-239326 | * | 9/1997 | B07C/3/08 |

* cited by examiner

*Primary Examiner*—Donald P. Walsh
*Assistant Examiner*—Daniel K Schlak
(74) *Attorney, Agent, or Firm*—Perkins Smith & Cohen LLP; Jacob N. Erlich; Peter J. Borghetti

(57) ABSTRACT

A mail handling system that imports data from a thickness measurement device regarding the thickness of a substantially flat mail article, counts the number of flat articles deposited on the top surface of the drop pocket, instructs the drop pocket to open to drop a unitary body of flat mail articles when the total stack thickness and/or number of articles exceeds threshold limits. A computer, operably connected to conventional conveyor system having, a drop pocket, a thickness measurement device, and a conveyor, implements the system.

18 Claims, 4 Drawing Sheets

DROP POCKET STACK HEIGHT AND OBJECT COUNT MONITORING SYSTEM AND METHOD

BACKGROUND OF THE INVENTION

This invention relates generally to mail article handling, and, more particularly to drop pocket door control.

Articles of mail currently are transported along a conveyor system with a plurality of drop pockets. Along the way the articles are sorted, identified, assigned, and oriented for a planned orderly placement in a specific drop pocket for distribution by the postal carrier. Sorting systems convey documents, such as mail, envelopes and the like, along a primary or main path from which the documents may be selectively diverted to a designated drop pocket or sorted according to predetermined criteria, such as a zip code as represented on a zip code label. An article will travel along the conveyor system until it reaches its designated drop pocket, at which time the drop pocket will open and the article is deposited within the drop pocket. The drop pocket will only open for those articles designated by a conveyor system controller for that specific drop pocket.

The objective of the conveyor system is to minimize the postal carriers' effort in resorting and reorienting the mail articles after distribution. However, this orderly process is disrupted in the final stage when the articles are dropped from the conveyor system into the drop pocket at a level that inherently causes some articles to float into the drop pocket, thereby becoming disoriented requiring the postal carrier to reorient and possibly resort the mail. This added step by the postal carrier delays the start of the delivery process and may cause misdelivery of the article.

Buffering systems for stacking documents before being dropped into a receptacle or a bin are disclosed, for example, in U.S. Pat. Nos. 5,101,981; 5,503,388; and 5,538,140. These patents monitor the stack height or the quantity or the document thickness temporarily stored in a drop pocket at an elevation higher than the receptacle or the bin. U.S. Pat. Nos. 5,503,388, by Guenther et al, and 5,538,140, Guntherer et al, disclose mechanical and electronic devices that measure the current stack thickness. U.S. Pat. No. 5,101,981, by Carbone et al, monitors the quantity of documents fed to the buffer. U.S. Pat. No. 6,126,017, by Hours, measures the document thickness prior to entry on to the conveyor system, tracks stack height in the drop pocket, and opens the drop pocket bottom door and drops the contents of the drop pocket into a receptacle or bin disposed below when the stack in the drop pocket is nearly full.

It is a significant drawback where a system cannot determine actually whether the next document to be fed to the drop pocket will exceed the drop pocket height limit. To avoid possible system jams, these systems must limit the fed documents to a substantially known, constant thickness or the activation height of the measuring device must be no higher than the thickness document except in the sort run or drop a stack before the optimal height is reached. Limiting fed documents to those that are substantially the same thickness or dropping the stack before optimal height is reached may impact throughput and efficiency

SUMMARY OF THE INVENTION

The present invention provides a system that takes into consideration the individual thickness of substantially flat articles, preferably mail articles, stacked on top of other flat articles in order to determine the optimum thickness and number of flat articles that can be dropped together face down and still remain a unitary body during the drop. For the purposes of the present invention, a unitary body is defined as a stack of substantially flat articles oriented approximately on top of each other such that when the stack is dropped from a predetermined height the aerodynamic characteristics of the stack with a plurality of articles has substantially the same aerodynamic characteristics of a single article of the same height and weight. In other words, the present invention sortation and orientation system insures that the stack of flat articles do not separate when dropping into an output receptacle.

A computer, a thickness measurement device, and a conveyor implement the present invention. The present invention imports data from the thickness measurement device in order to ascertain the thickness of the next flat article. In addition thereto, the system of this invention counts the number of flat articles deposited on the top surface of the drop pocket door. By analyzing this information, a computer generates a signal to open the drop pocket that permits the dropping of a unitary body of substantially flat articles, when the total stack thickness and/or number of articles reaches threshold limits.

For a better understanding of the present invention, together with other and further objects thereof, reference is made to the accompanying drawings and detailed description and its scope will be pointed out in the appended claims.

DETAILED DESCRIPTION OF THE PREFERRED EMBODIMENTS

The present invention is now described more fully hereinafter with reference to the accompanying drawings, in which the preferred embodiment of the invention is shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. The preferred embodiment is illustrated utilizing mail flats or substantially flat articles but the system or method of this invention is applicable to any system that utilizes objects that are stackable.

Figure 1:
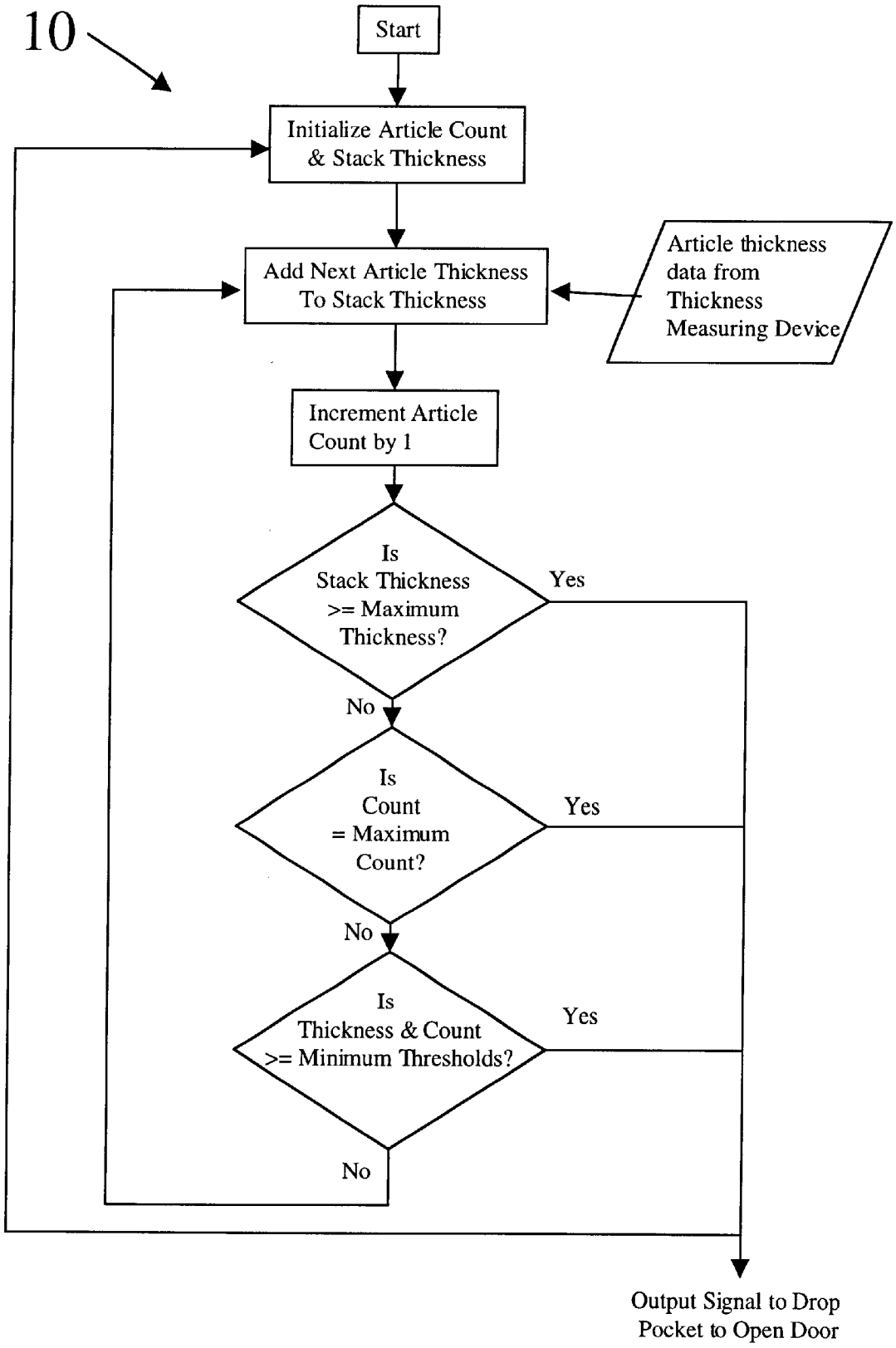
FIG. 1 is a flow diagram illustrating the logic utilized within the system of the present invention.

The preferred embodiment of this invention, being a system generally indicated by numerical designation 10, is illustrated in FIG. 1. The present invention takes into consideration the individual thickness of objects, such as flat mail articles, to be stacked on top of other objects or like articles in order to determine the optimum thickness and number of flat mail piece that can be dropped together face down and still remain as a unitary body during the drop without the stack separating.

Figure 2:
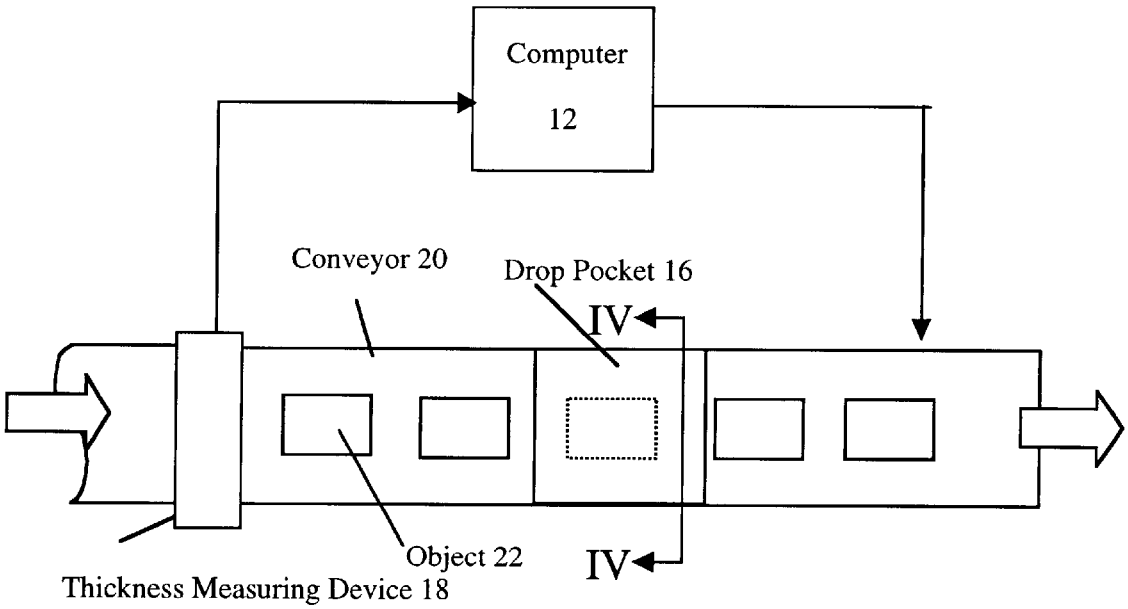
FIG. 2 is a schematic representation of a conveyor system configured to utilize the system of the present invention.

The system 10 is implemented by a computer 12 operably connected to conventional conveyor system having a drop pocket 16, a thickness measurement device 18, and a conveyor 20, as illustrated in FIG. 2. A conveyor 20 automatically directs object 22, such as a mail article, to be stacked in drop pockets 16. Single objects 22 travel along a conveyor 20 to a commercially available thickness-measuring device 18, such as a shaft encoder or optical scanner. The object 22 then advances to a conventional drop pocket 16 to be stacked and await an instruction from the computer 12 that opens the drop pocket 16. The objects 22 are stacked on top of each other in the same orientation as received. Returning to FIG. 1, the system 10 sums the object thickness' to determine a stack thickness (or height) and sums the number of objects on the stack. When the stack thickness or object count reach threshold limits or minimum conditions explained in greater detail below, then drop pocket 16 opens, the stack of objects drop as a unitary body, and the counters are reset for the next batch of objects.

Figure 3:
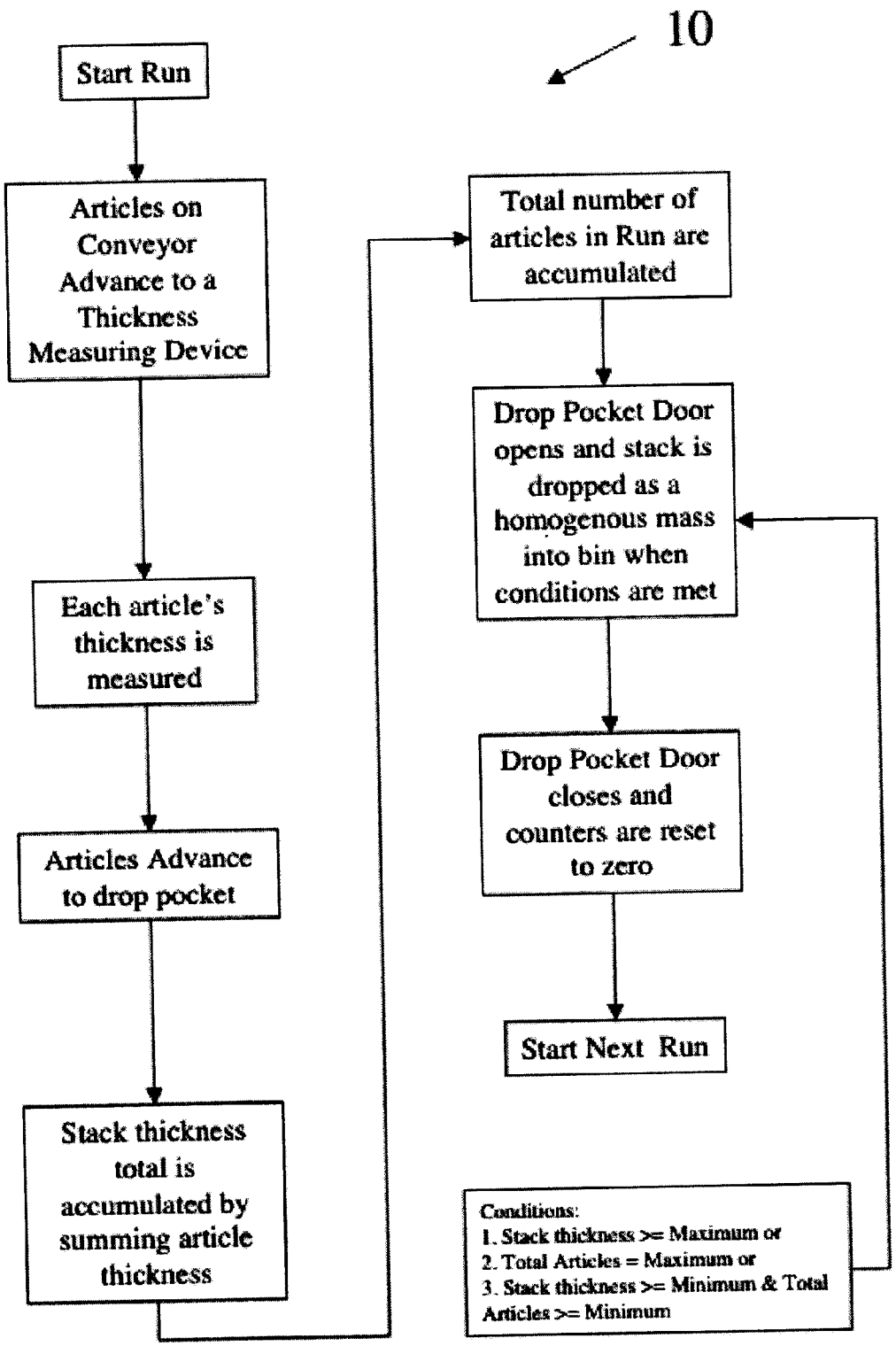
FIG. 3 is a flow chart that describes the operation of the system of the present invention.

The process steps of the system 10 are indicated in FIG. 3. In the preferred embodiment of the present invention, there are three conditions monitored by the computer 12 on a constant basis to determine whether an instruction would be sent to the drop pocket 16 to open. For illustration purposes, the stack thickness ranges from 1-inch (minimum) to 1.5 inches (maximum) and the article count ranges from 1 (minimum) to 10 (maximum) articles. The first condition checked is whether the stack thickness reaches the maximum value (1.5 inches). If so, then the computer 12 generates an instruction to the drop pocket 16 to open. If not, then a second check is performed to determine whether the number of articles equals the maximum value (10 articles). If so, then an instruction is sent to the drop pocket 16 to open. If not, a third check is performed whether the minimums of both conditions are exceeded (for example, a 1-inch stack thickness and 1 article). If so, then an instruction is sent to the drop pocket 16 to open. The objective of the limits is to optimize the process where the throughput is maximized and the resorting is minimized, if not eliminated all together. Therefore, these limits are for illustration purposes only and will increase or decrease based on the throughput requirements of each conveyor system, the size of the articles and capability of the drop pockets.

Figure 4A:
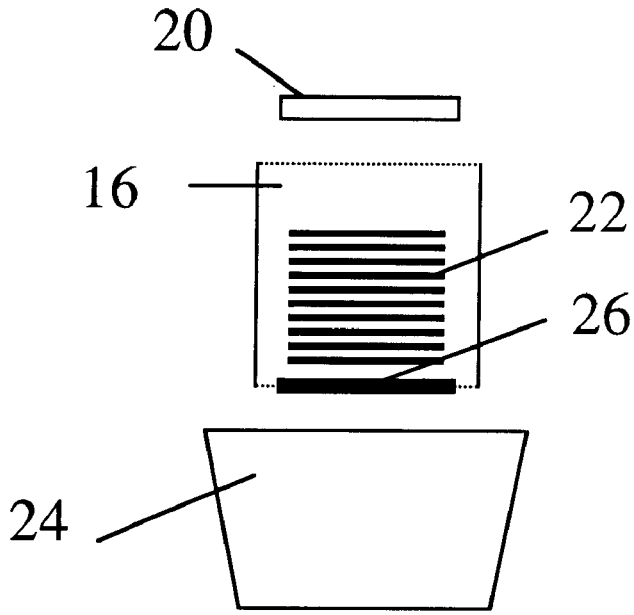
FIGS. 4*a* and 4*b* are schematic section views of IV—IV of FIG. 2 showing the drop pocket containing mail items during the stacking operating and dropping the mail items as a unitary body in accordance with the present invention.
Figure 4B:
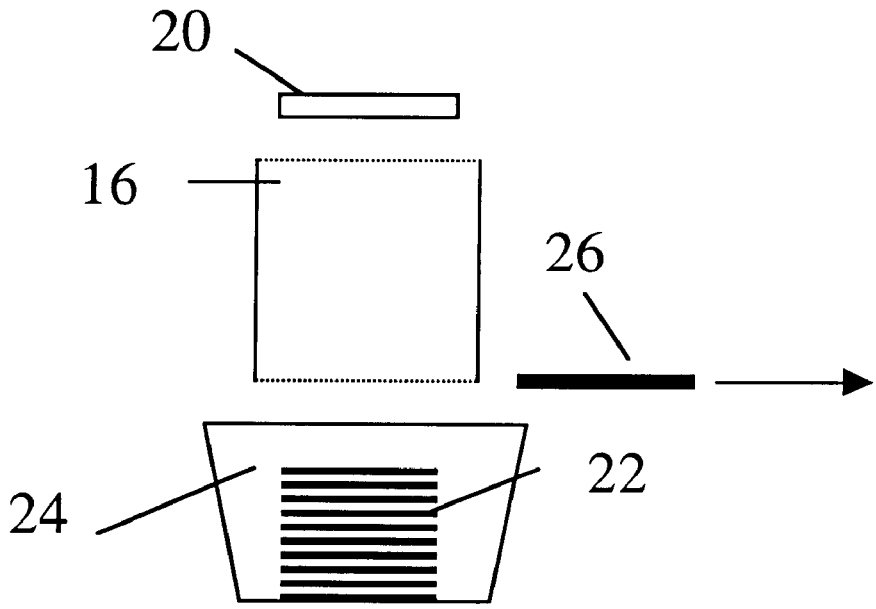

FIGS. 4*a* and 4*b* are section views of IV—IV of FIG. 2 showing the conveyor 20 with a drop pocket 16 and output receptacle 24 for transporting objects, for example mail articles 22. The system 10 provides a drop pocket 16 at each output receptacle 24. These drop pockets 16 are mounted on a structure (not shown) supporting the conveyor 20. Each drop pocket 16 is preferably vertically aligned with the corresponding output receptacle 24 so that mail articles 22 are transferred from the drop pocket 16 to the corresponding output receptacle 24 by gravity, which helps to simplify the layout of the conveyor. Each drop pocket 16 is adapted to store at least temporarily a certain quantity of mail articles 22. The drop pocket 16 has a generally retractable bottom, for example a horizontally sliding door 26 adapted to be closed for storage, as shown in FIG. 4*a*, or opened to release the mail articles 22 into the corresponding output receptacle 24, as shown in FIG. 4*b*. Other types of closure/opener devices can also be utilized with the present invention, for example a sweeper that will push the unitary body to an output receptacle waiting along side the drop pocket.

As mentioned above, to stack objects, such as mail articles 22, with a device of this kind, the computer 12 is programmed to monitor the stack height (or thickness) and the quantity of objects stacked in each drop pocket 16 on the basis of information supplied by the measuring device 18. The computer 12 retains the drop pocket 16 in a normally closed position as shown in FIG. 4*a*. The mail articles 22 are stacked temporarily in the drop pocket 16. On detecting that the drop pocket 16 exceeds the stack height and/or object count limits, the computer 12 commands the opening of the drop pocket door 26 to open with sufficient speed to overcome frictional effects and drop the temporarily stacked mail articles 22 into the corresponding output receptacle 24, as shown in FIG. 4*b*, as a unitary body. A unitary body will not bend significantly due to the cumulative stiffness of the individual mail articles 22, thereby maintaining the object sequence and orientation. As the mail articles 22 are stored flat, both in the drop pocket 16 and in the output receptacle 24, the mail articles 22 are stored more efficiently in the receptacle 24 by transferring them as a unitary body rather than by transferring them individually.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A system for monitoring and delivering a stack of objects for use with a conveyor that directs the objects to at least one drop pocket, said system comprising:

means for receiving signals indicative of a thickness of a next object directed by the conveyor to the at least one drop pocket;

stack height calculation means for calculating a future stack height, said stack height calculation means being capable of a summation of a height of the stack of objects actually in the at least one drop pocket and the thickness of the next object directed by the conveyor to the at least one drop pocket in response to said received signals;

stack height monitor means for determining whether said future stack height exceeds a capacity of the at least one drop pocket;

said stack height monitor means further providing an output indicative of said future stack exceeding the capacity of the at least one drop pocket;

said calculating, said determining, and said providing taking place prior to the next object actually being delivered to the at least one drop pocket;

means for signaling the at least one drop pocket to deliver the stack to a receptacle prior to the next object reaching the at least one drop pocket in response to said output of said stack height monitor means, whereby, the stack in the at least one drop pocket is delivered to the receptacle before the next object reaches the at least one drop pocket.

2. A system for forming and delivering a stack of objects for use with a conveyor that directs the objects to at least one drop pocket, said system comprising:

means for outputting signals indicative of a dimension of each one of the objects directed by the conveyor to the at least one drop pocket;

stack height calculation means for calculating height of the stack in the at least one drop pocket in response to said output signals of said outputting means;

stack height monitor means for monitoring whether a next object to be directed to the at least one drop pocket will exceed a predetermined stack height limit and provide an output indicative thereof;

object count calculation means for calculating object count in the at least one drop pocket based on said output signals of said outputting means, wherein said object count calculation means for calculating object count increments a counter by one for each of said output signals of said outputting means;

object count monitor means for monitoring whether the next object to be directed to the at least one drop pocket will exceed a predetermined object count limit and provide an output indicative thereof; and means for signaling the at least one drop pocket to deliver the stack in response to said output of said stack height calculation means and in response to said output of said object count monitor means when the next object to be directed to the at least one drop pocket will cause said stack height and said stack object count to exceed either of said predetermined stack height limit or said predetermined object count limit or both said limits;

whereby, the stack in the at least one drop pocket is delivered to the output receptacle before the next object reaches the at least one drop pocket when said predetermined stack height limit and said predetermined stack height limit and said predetermined object count limit.

3. The system as claimed in 2, wherein said predetermined object count limit comprises a maximum object count.

4. The system as claimed in 2, wherein said predetermined object count limit comprises a minimum object count.

5. The system as claimed in 2, wherein:

said means for signaling the at least one drop pocket further delivers the stack to the output receptacle in response to said stack height monitor means output and said object count monitor means output when the next object to be directed to the at least one drop pocket will cause said stack height and said object count to exceed said predetermined stack height limit and said predetermined object count limit, whereby, the stack in the at least one drop pocket is delivered to the output receptacle before the next object reaches the at least one drop pocket.

6. The system as claimed in 5, wherein said predetermined stack height limit comprises a maximum stack height.

7. The system as claimed in 5, wherein said predetermined stack height limit comprises a minimum stack height.

8. The system as claimed in 5, wherein said predetermined object count limit comprises a maximum object count.

9. The system as claimed in 5, wherein said predetermined object count limit comprises a minimum object count.

10. A system for monitoring and delivering a stack of objects for use with a conveyor that directs the objects to at least one drop pocket, said system comprising:

means for outputting signals indicative of a dimension of each one of the objects directed by the conveyor to the at least one drop pocket;

means for calculating stack height and object count in the at least one drop pocket based on said output signals of said outputting means, wherein said means for calculating stack height and object count increments a counter by one for each of said output signals of said outputting means;

means for monitoring whether the next object to be directed to the at least one drop pocket will cause said stack height in the at least one drop pocket to exceed a stack height predetermined limit or to exceed an object count predetermined limit or to exceed said stack height predetermined limit and said object count predetermined limit;

providing an output from said means for monitoring indicative of said stack height or said object count or said stack height and said object count;

means for signaling the at least one drop pocket to deliver the stack to an output receptacle in response to said monitoring means output when a next object to be directed to the at least one drop pocket will cause said stack height predetermined limit or said object count predetermined limit or said stack height predetermined limit and said object count predetermined limit to be exceeded, whereby, the stack in the at least one drop pocket is delivered to the output receptacle before the next object reaches the at least one drop pocket.

11. The system as claimed in 10, wherein said stack height predetermined limit comprises a maximum stack height.

12. The system as claimed in 10, wherein said stack height predetermined limit comprises a minimum stack height.

13. The system as claimed in 10, wherein said object count predetermined limit comprises a maximum object count.

14. The system as claimed in 10, wherein said object count predetermined limit comprises a minimum object count.

15. A method for monitoring and delivering a stack of objects for use with a conveyor that directs the objects to at least one drop pocket, said method comprising the steps of:

receiving signals indicative of a thickness of a next object directed by the conveyor to the at least one drop pocket prior to the next object being delivered to the at least one drop pocket;

summing an actual stack height in the at least one drop pocket based upon the thickness of the next object directed by the conveyor to the at least one drop pocket in response to the received signals prior to the next object being delivered to the at least one drop pocket;

determining whether a summation of the step of summing exceeds a capacity of the at least one drop pocket prior to the next object being delivered to the at least one drop pocket;

providing an output when the summation exceeds the depth capacity of the at least one drop pocket prior to the next object being delivered to the at least one drop pocket; and providing a signal to the at least one drop pocket to deliver the stack to a receptacle in response to the output prior to the next object being delivered to the at least one drop pocket, whereby, the stack in the at least one drop pocket is delivered to the receptacle before the next object reaches the at least one drop pocket and the next object is the first object in a new stack in the at least one drop pocket.

16. A method for monitoring and delivering a stack of objects for use with a conveyor that directs the objects to at least one drop pocket, said method comprising the steps of:

receiving signals indicative of a dimension of each one of the objects directed by the conveyor to the at least one drop pocket;

calculating stack height in the at least one drop pocket in response on the received signals;

monitoring whether a next object to be directed to the at least one drop pocket will cause the stack height to exceed a predetermined stack height limit;

calculating object count in the at least one drop pocket in response to the received signals by incrementing a counter by one for each of the received signal signals;

monitoring whether the next object to be directed to the at least one drop pocket will exceed a predetermined object count limit;

providing a signal to the at least one drop pocket to deliver the stack to the output receptacle when the next object to be directed to the at least one drop pocket will cause the stack height to exceed the predetermined stack height or the object count to exceed the predetermined object count limit, whereby, the stack in the at least one drop pocket is delivered to the output receptacle before the next object reaches the at least one drop pocket.

17. The method as claimed in 16, further comprising the step of:

providing the signal to the at least one drop pocket to deliver the stack to the output receptacle when the next object to be directed to the at least one drop pocket will cause the stack height and the object count to exceed the predetermined stack height limit and the predetermined object count limit.

18. The method as claimed in 17, wherein:

the predetermined stack height limit comprises a maximum stack height or a minimum stack height; and the predetermined object count limit comprises a maximum object count or a minimum object count.

* * * * *

UNITED STATES PATENT AND TRADEMARK OFFICE

CERTIFICATE OF CORRECTION

PATENT NO. : 6,749,194 B2
DATED : June 15, 2004
INVENTOR(S) : Bruce H. Hanson et al.

It is certified that error appears in the above-identified patent and that said Letters Patent is hereby corrected as shown below:

Column 5,
Line 14, "said stack object count" should read -- said object count --;
Line 19, "pocket, when said predetermined stack height limit and said predetermined stack height limit and said predetermined object count limit" should read -- pocket. --;

Column 6,
Line 61, "response on" should read -- response to --.

Signed and Sealed this

Tenth Day of August, 2004

JON W. DUDAS
*Acting Director of the United States Patent and Trademark Office*